US006315831B1

(12) United States Patent
Renetta

(10) Patent No.: US 6,315,831 B1
(45) Date of Patent: Nov. 13, 2001

(54) PAINT GUARD FOR USE WITH TRIM AND MOLDING

(76) Inventor: Robert Renetta, 5841 Langmere St, East Syracuse, NY (US) 13057

( * ) Notice: Subject to any disclaimer, the term of this patent is extended or adjusted under 35 U.S.C. 154(b) by 0 days.

(21) Appl. No.: 09/369,965

(22) Filed: Aug. 6, 1999

(51) Int. Cl.[7] ..... B05C 21/00
(52) U.S. Cl. ..... 118/503; 118/504
(58) Field of Search ..... 118/503, 504

(56) References Cited

U.S. PATENT DOCUMENTS

| | | | | |
|---|---|---|---|---|
| 695,965 | * | 3/1902 | Taylor et al. | 118/504 |
| 1,434,903 | * | 11/1922 | Manning | 118/504 |
| 2,754,799 | * | 7/1956 | Crawford | 118/504 |
| 3,565,038 | * | 2/1971 | Barriger | 118/504 |

FOREIGN PATENT DOCUMENTS

| | | | | |
|---|---|---|---|---|
| 695572 | * | 8/1953 | (GB) | 118/504 |

* cited by examiner

*Primary Examiner*—Laura Edwards
(74) *Attorney, Agent, or Firm*—George R. McGuire; Hancock & Estabrook, LLP

(57) ABSTRACT

The present invention provides a guard that may be attached to molding or trim during painting operations to prevent paint from dripping or splashing from a surface to be painted one color onto a surface to be painted a different color or which will remain unpainted. In its primary embodiment, the present invention provides an elongated strip of material, preferably plastic, having a cross-sectional shape consisting of a terminal first end which extends around in a generally U-shaped hook pattern, a relatively straight central section integrally extending from the non-terminal end of the hook section, and a curved section that extends along a predetermined radius and terminates with a relatively straight portion that extends essentially perpendicularly to the central section.

4 Claims, 5 Drawing Sheets

PAINT GUARD FOR USE WITH TRIM AND MOLDING

BACKGROUND OF THE INVENTION

The present invention relates generally to painting accessories, and more particularly to accessories for preventing paint from dripping onto or otherwise coating molding and trim while painting a wall.

Molding extending along a wall adjacent to the floor and/or ceiling, and wooden trim framing doors and windows are common architectural features found in homes and buildings. For aesthetic reasons, it is typical for the molding and trim to be painted a different color than the major surface of the wall to which they are attached. Thus, in order to prevent paint being applied to a wall from dripping onto the molding or trim, it is necessary to position a barrier between the molding or trim and the wall.

Most often this barrier is created by adhering masking tape to the molding or trim at the interface of the wall. Although this tape barrier effectively protects molding and trim from being coated with the wall paint, it is difficult and time consuming to accurately run the tape along the entire length of the molding and trim, often requiring multiple efforts to properly align the tape. In addition, adhesive material sometimes remains on the molding and trim after the tape is removed, thereby requiring cleaning and/or scraping to remove the adhesive material. Accordingly, the time consuming, laborious effort of taping molding and trim is an undesirable procedure for creating a barrier to prevent paint being applied to a wall from dripping onto or otherwise coating the molding and trim.

A readily available alternative to taping is a spatula-like instrument that may be held in one hand by a painter at the interface of the wall and molding or trim, while he or she paints the wall with the other hand. Notwithstanding the inconvenience and dexterity needed to hold the tool in one hand while holding a brush or roller to paint the wall in the other hand, the blades on these tools are generally less than a foot long, thereby requiring it to be constantly moved during the course of painting the wall. As the blade is moved, often paint will drip onto its edge resulting in paint being transferred therefrom to the molding or trim. Thus, not only is use of this type of tool difficult, it is also ineffective in many instances.

It is therefore a principal object and advantage of the present invention to provide a device that creates an effective barrier between a wall and the molding and trim attached thereto when the well is being painted.

It is another object and advantage of the present invention to provide a paint guard that may be easily and quickly attached to molding and trim in order to prevent paint from coating them as a result of paint dripping or splashing from a wall.

It is a further object and advantage of the present invention to provide a paint guard that may be securely attached in complete covering relation to molding or trim without scratching or otherwise damaging the same.

It is an additional object and advantage of the present invention to provide a paint guard that prevents paint from dripping on floors in addition to a strip of molding to which the guard is attached.

Other objects and advantages of the present invention will in part be obvious, and in part appear hereinafter.

SUMMARY OF THE INVENTION

In accordance with the foregoing objects and advantages, the present invention provides a guard that may be attached to molding or trim during painting operations to prevent paint from dripping or splashing from a surface to be painted one color onto a surface to be painted a different color or which will remain unpainted. In its primary embodiment, the present invention provides an elongated strip of material, preferably plastic, having a cross-sectional shape consisting of a terminal first end which extends around in a generally U-shaped hook pattern, a relatively straight central section integrally extending from the non-terminal end of the hook section, and a curved section that extends along a predetermined radius and terminates with a relatively straight portion that extends essentially perpendicularly to the central section. Extrusion has been determined to be the most efficient and cost effective method for manufacturing the guard, although other manufacturing methods, such as injection molding or casting, certainly could be employed.

In use, when painting a wall and desiring to prevent paint from dripping onto molding and the floor, the guard is positioned in complete covering relation to the molding by placing the guard's hooked end in engaging relation to the upper edge of the molding, with the central section extending in covering relation to the body of the molding, and the curved section extending outwardly from the molding in overlapping relation to the floor (or in underlapping relation to the ceiling if protecting crown molding). The relatively thin cross-section of the guard permit is to be securely engaged with the molding with no appreciable gap between the wall and molding.

The guard may also be used to prevent paint from coating a wall when painting molding. In this application, the guard is positioned with its curved portion inserted between the wall and molding, the central section extending outwardly therefrom in at least partially contacting relation to the wall, and the U-shaped hook portion positioned in laterally spaced relation to the wall and in overhanging relation to the molding.

In addition, the guard may be used to prevent paint from dripping onto the floor (or ceiling) when painting the molding. For this application, the guard is positioned with its curved end positioned between the molding and floor (or ceiling), and the central section extending outwardly therefrom in covering relation to the floor (or ceiling).

In an alternative embodiment to be used with trim around doors and windows, the cross-sectional shape is defined by a first section that extends along a straight path from a terminal end to a bend where it integrally transitions to a central section that extends along a straight path before it bends at a second predetermined, acute angle which is greater than the first angle, and integrally transitions to a third section which extends along a straight path before terminating. In use, this embodiment is positioned in complete covering relation to a length of trim with the first section being positioned between the wall and trim, the central section positioned in covering relation to the trim, and the third section extending around the edge of the molding that is not in contact with the wall. As with the primary embodiment, this embodiment is also preferably made of plastic and manufactured by an extrusion process, although other materials and manufacturing processes could also be used.

BRIEF DESCRIPTION OF THE DRAWINGS

The present invention will be more fully understood by reading the following Detailed Description in conjunction with the accompanying drawings, wherein.

DETAILED DESCRIPTION

Figure 4:
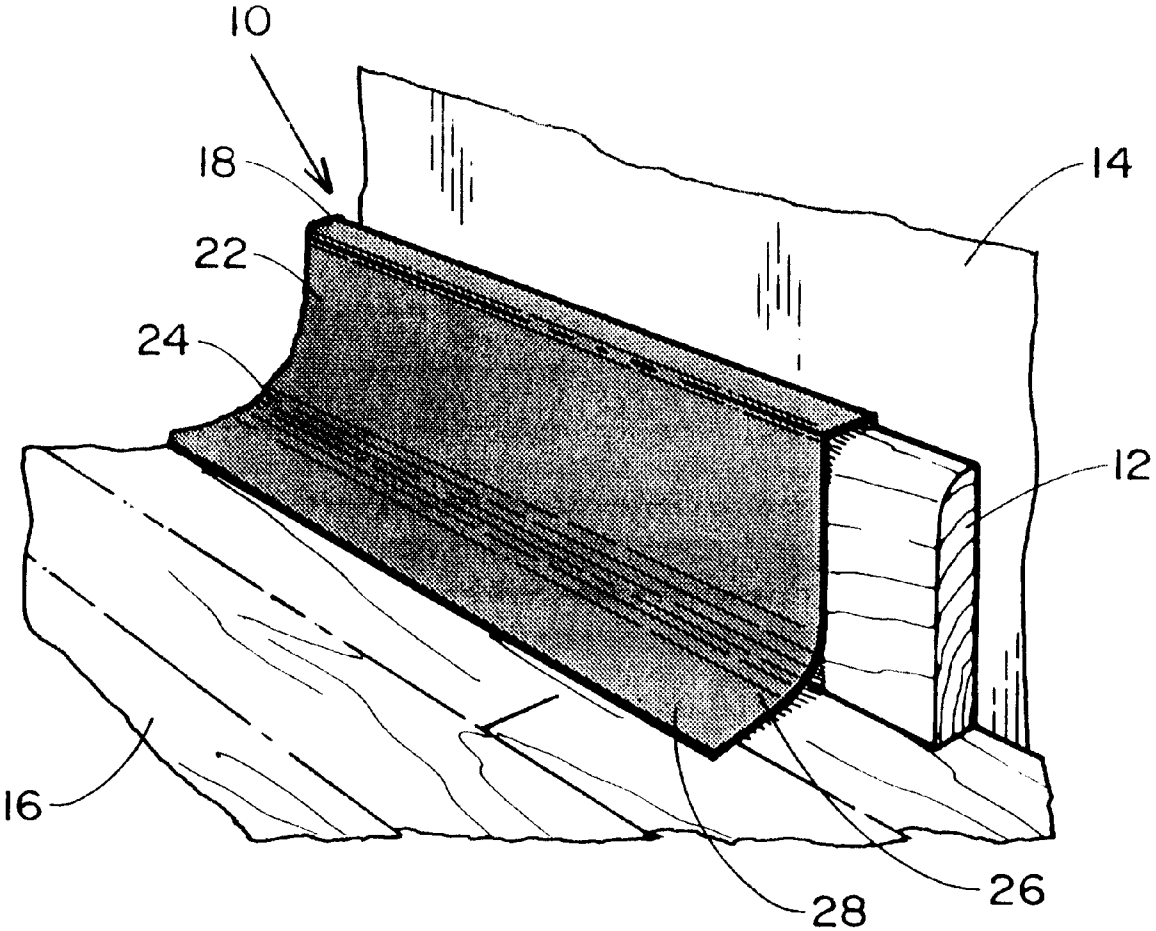
FIG. 4 is a perspective view illustrating use of the primary embodiment in a first application.
Figure 5:
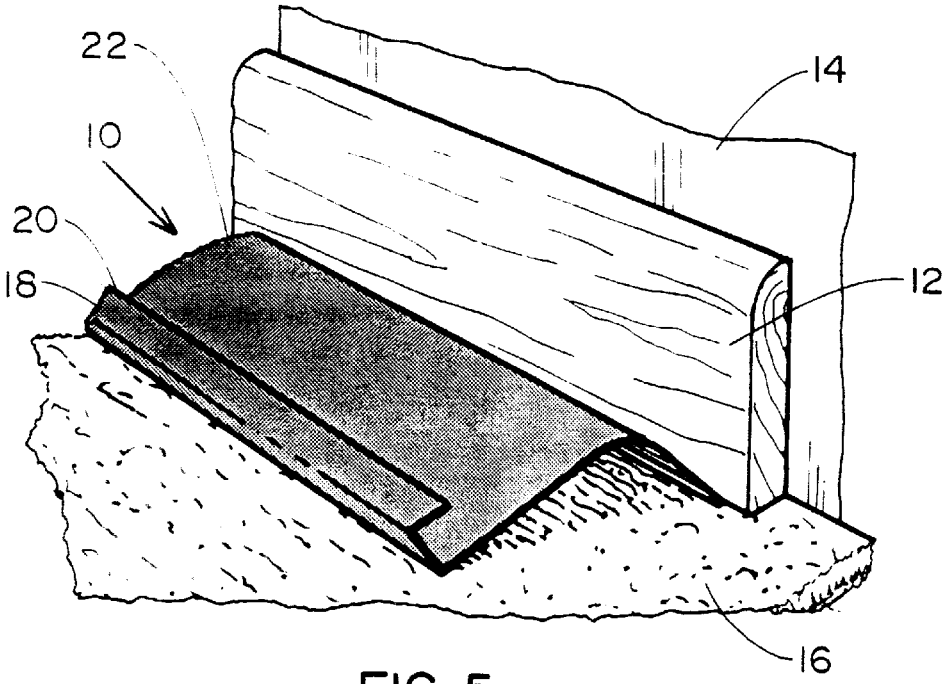
FIG. 5 is a perspective view illustrating use of the primary embodiment in a second application.
Figure 6:
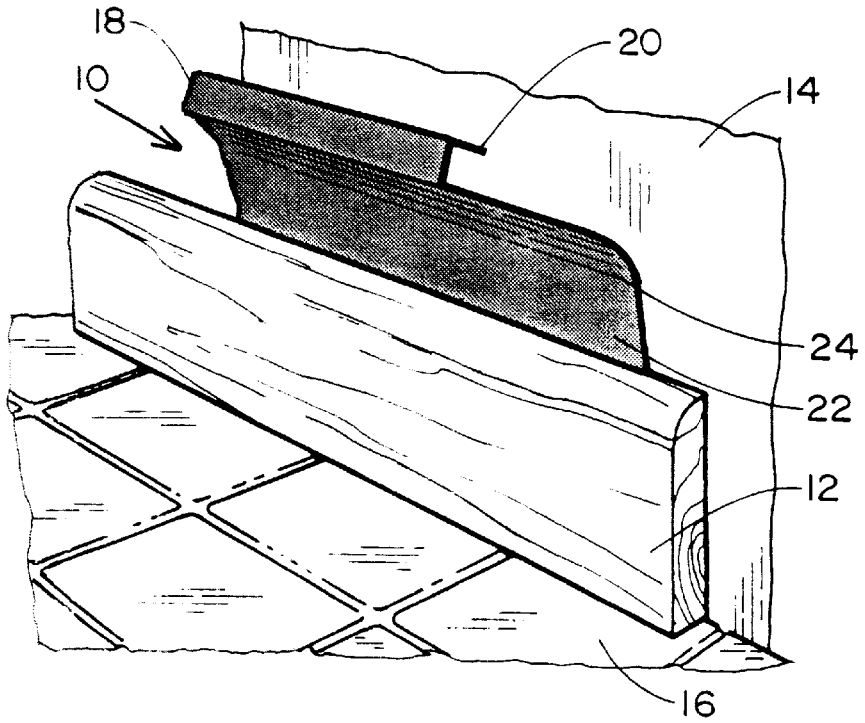
FIG. 6 is a perspective view illustrating use of the primary embodiment in a third application.
Figure 7:
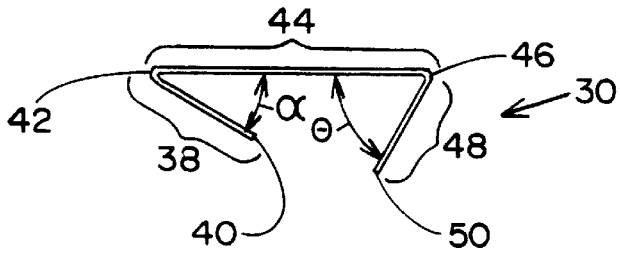
FIG. 7 is an end elevational view of a second embodiment of the present invention, effectively illustrating its cross-sectional shape.
Figure 8:
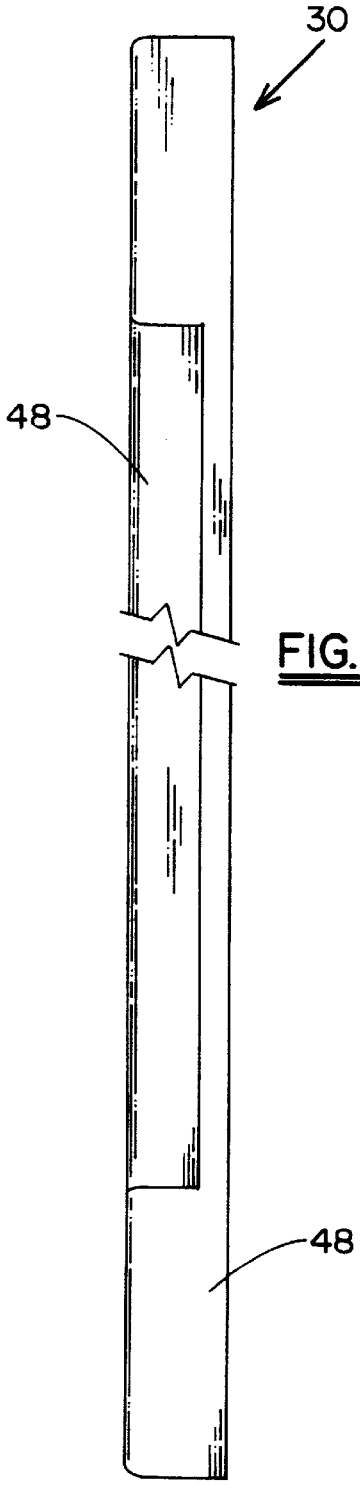
FIG. 8 is a front elevational view thereof.
Figure 9:
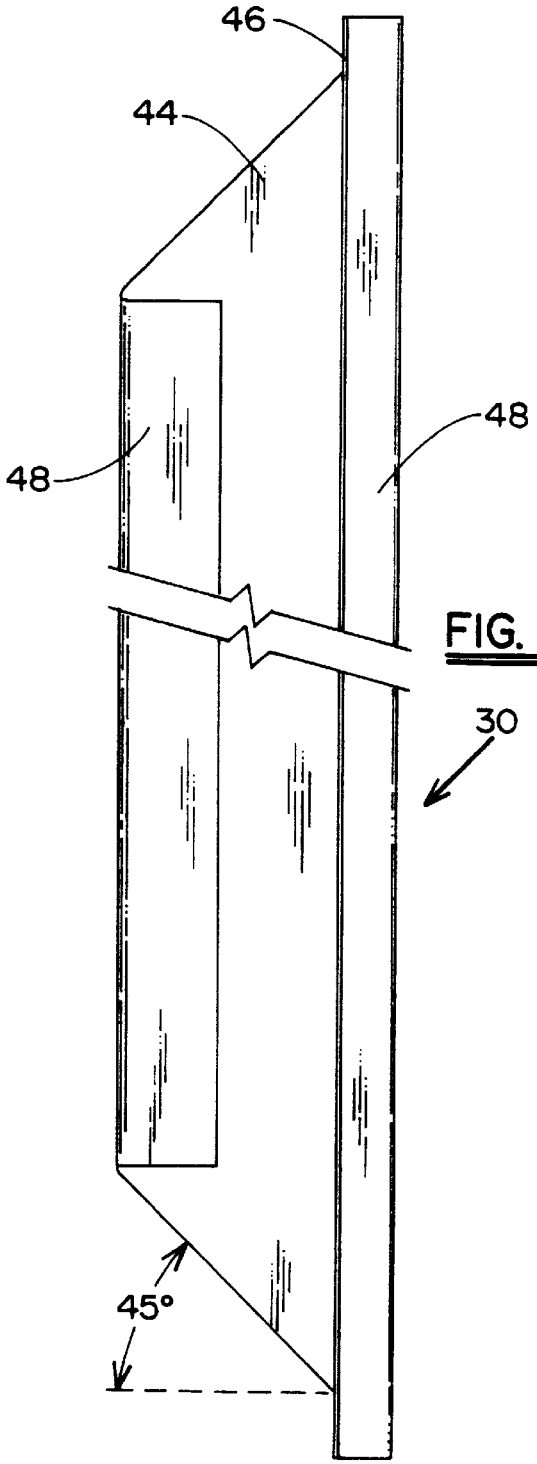
FIG. 9 is a rear elevational view thereof.

Referring now to the drawings, wherein like reference numerals refer to like parts throughout, there is seen in FIGS. 1–6 a primary embodiment of a paint guard, designated generally by reference numeral 10, for use with molding 12 (see FIGS. 4–6). Molding 12 is illustrated as extending along a wall 14, adjacent a floor 16, but guard 10 could equally be used in the same manners described hereinafter with crown moldings, shadow boxes, and the like.

Figure 1:
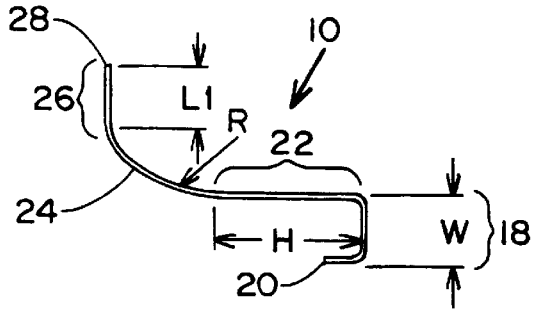
FIG. 1 is an end elevational view of the primary embodiment of the present invention, effectively illustrating its cross-sectional shape.
Figure 2:
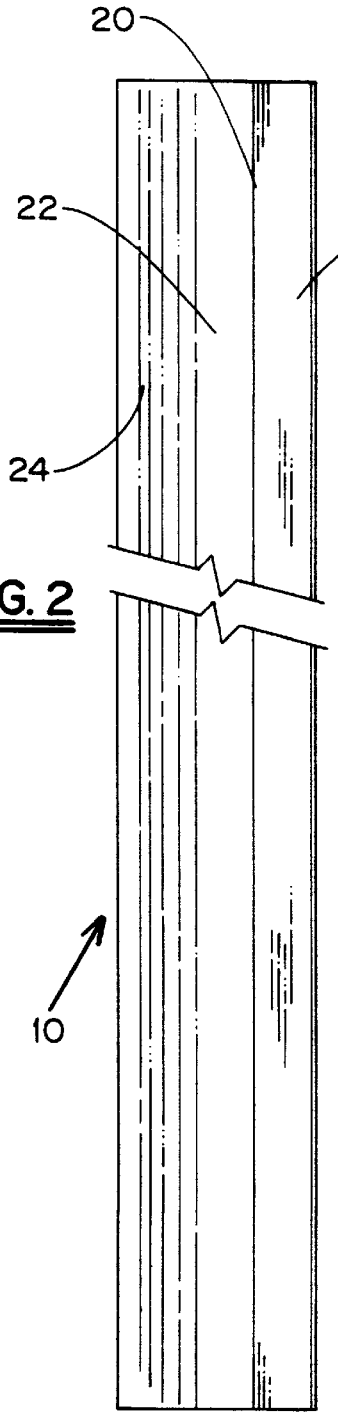
FIG. 2 is a rear elevational view thereof.
Figure 3:
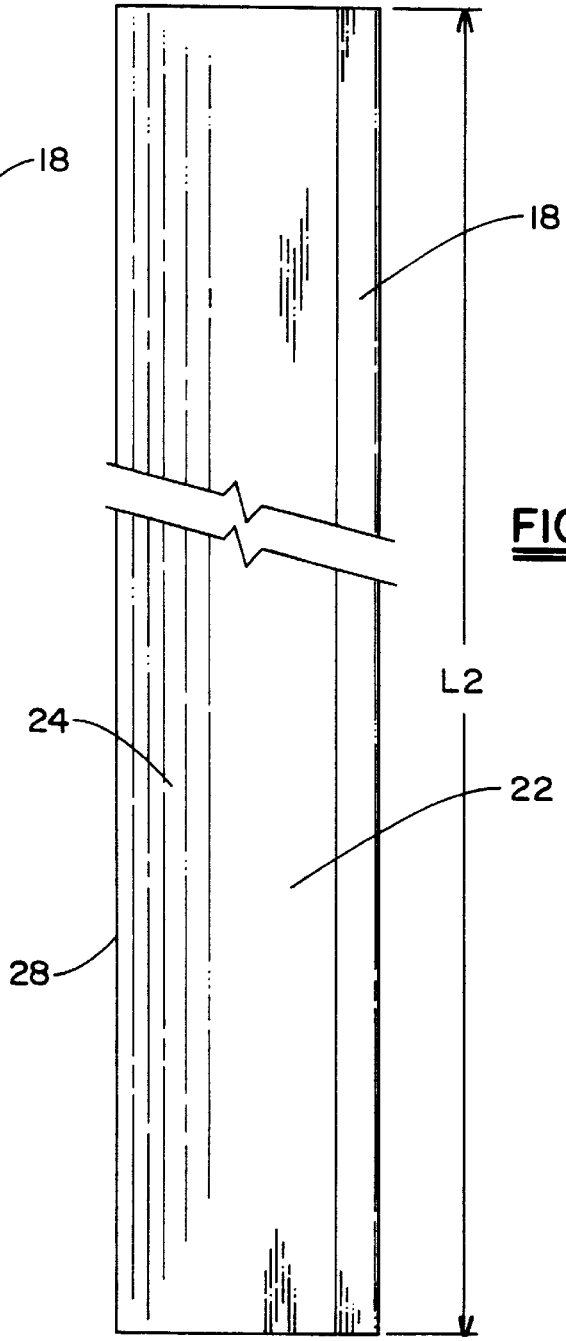
FIG. 3 is a front elevational view thereof.

Guard 10 is of a predetermined cross-sectional shape, as illustrated in FIG. 1, defined by a U-shaped hook section 18 which continuously extends from a first, terminal end 20 around the hook to a central section 22 which, in turn, extends along a relatively straight path from the non-terminal end of section 18 until it integrally transitions along a bend 24 of predetermined radius R into a final section 26 which extends essentially perpendicularly to section 22 until it terminates in second, terminal end 28. The width W of section 18, height H of section 22, length L1 of section 26 and length L2 of guard 10 are predetermined, and may be changed depending upon the type of molding on which guard 10 is to be used, but in standard form would be sufficient to essentially, completely cover a 4' section of standard 4" molding. While the preferred material for guard 10 is plastic and method of manufacture is extrusion, other materials and manufacturing methods could be employed without departing from the spirit and scope of the present invention.

FIG. 4 illustrates a first application of guard 10, employed when painting a wall 14 and desiring to prevent the wall paint from dripping or splashing onto molding 12 or floor 16. For this application, guard 10 is positioned with hook section 8 engaged with the upper edge of molding 18 and end 20 positioned between the molding and wall 14; central section 22 extending in covering relation to the body of molding 12; and bend 24 and section 26 extending outwardly from molding 12 in partially covering relation to floor 16. Accordingly, any paint that may splash or drip from wall 14 will be prevented from contacting molding 12 and floor 16 in those areas where guard 10 is positioned.

FIG. 5 illustrates a second application of guard 10 employed when painting the lower portion or body of molding 12 and desiring to prevent paint from dripping onto floor 16. For this application, guard 10 is positioned with section 26 extending between molding 12 and floor 16, and section 22 extending outwardly therefrom. Accordingly, any paint that may drip from molding 12 will be collected by guard 10 instead of contacting floor 16.

FIG. 6 illustrates a third embodiment of guard 10 employed when painting the upper portion of molding 12 and desiring to prevent paint from splashing on wall 14. For this application, guard 10 is positioned with section 26 extending between molding 12 and wall 14; central section 22 extending upwardly therefrom; and hook section 18 positioned in laterally spaced relation to wall 14. Accordingly, when positioned in this manner, guard 10 will collect any paint that would otherwise contact wall 14 (e.g., when painting molding 12).

Figure 11:
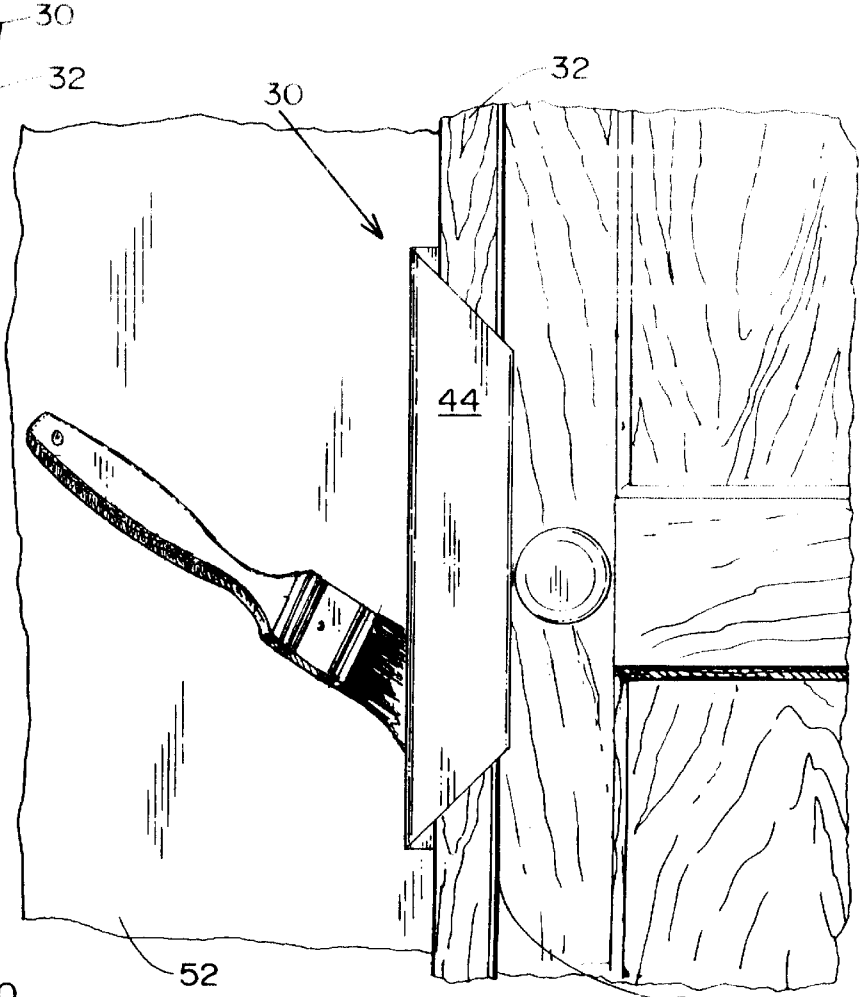
FIG. 11 is a perspective view illustrating use of the second embodiment with trim around a window pane.

Referring now to FIGS. 7–11, there is seen a second embodiment of the present invention consisting of a paint guard, denoted generally by reference numeral 30, for use with trim 32 positioned around a window pane 34 (see FIG. 10) or a doorjamb 36 (see FIG. 11). Guard 30 is of a predetermined cross-sectional shape defined by a first section 38 that extends along a relatively straight path from a terminal end 40 to a transition point 42; a second section 44 extending along a relatively straight path from transition point 42 to transition point 46; and a third section 48 that extends along a relatively straight path from transition point 46 to terminal end 50. First section 38 is integral with, and offset at a predetermined acute angle $\alpha$ from second section 44, and second section 44 is integral with, and offset at a predetermined acute angle $\theta$ from third section 48. Angle $\alpha$ is less than angle $\theta$, but the precise degrees are custom chosen to best fit around the trim, although standard angles of about 55 degrees and 80 degrees have been found to fit well with standard trim packages. In addition, the periphery of guard 30 is shaped in the form of a trapezoid with the edges of section 44 tapering inwardly at about 45 degree angles from section 48 to section 38, in order to match the miter cuts typically used in cutting trim to properly frame windows and doors.

Figure 10:
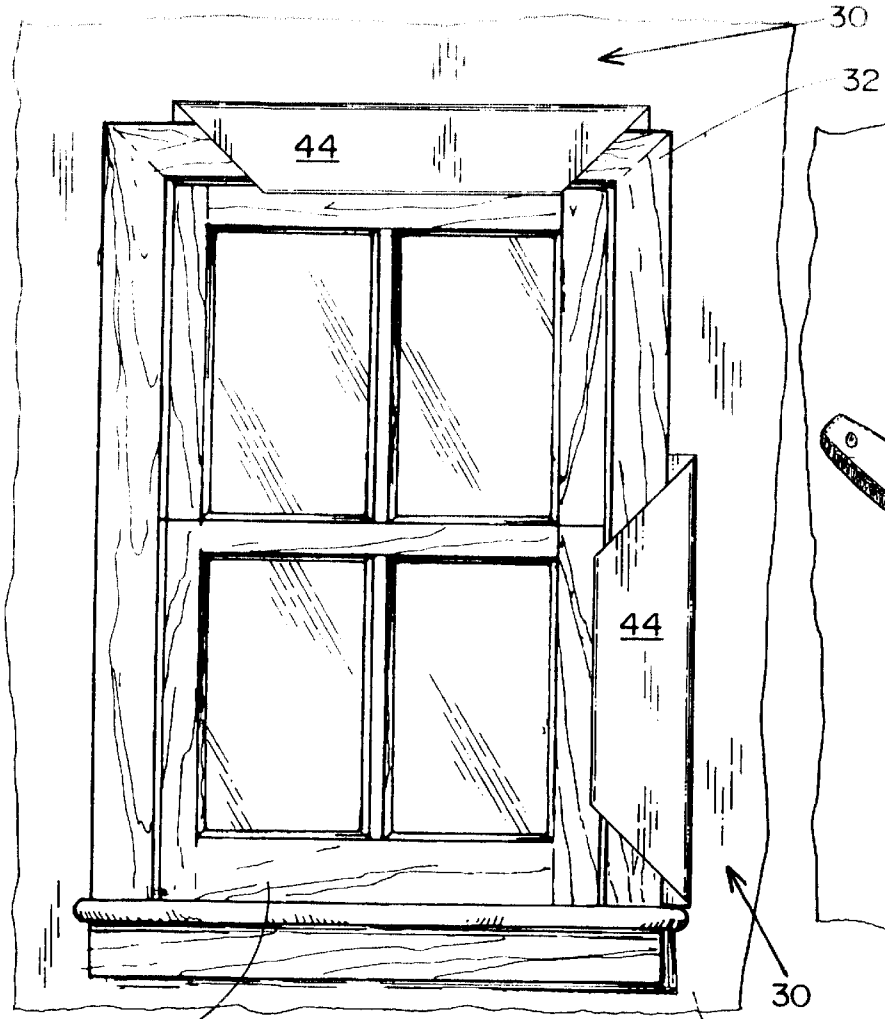
FIG. 10 is a perspective view illustrating use of the second embodiment with trim around a door jamb.

FIGS. 10 and 11 show guard 30 in use with window trim and door trim, respectively. For each of these applications, guard 30 is positioned with section 48 engaged over the outer edge of trim 32 with end 40 being positioned between wall 52 and trim 32; section 44 in covering relation to the body of trim; end section 38 engaged over the inner edge of trim 32 with end 40 positioned between trim 32 and window pane 34 or door 36. Accordingly, guard 30 will prevent any paint from coating trim 32 while wall 52 is being painted.

As with guard 10, guard 30 is preferably made of plastic and manufactured by an extrusion process, although other materials and manufacturing processes can also be employed.

What is claimed is:

1. A guard for preventing a first colored paint used to coat a first surface from contacting a second surface which is positioned in contacting relation to said first surface said guard comprising;

(a) an elongated member extending along a longitudinal axis and having:

(i) a first section extending parallel to said longitudinal axis and having a terminal edge, said first section adapted to be positioned in engaging relation to said second surface with said terminal edge positioned between said first and second surfaces;

(ii) a second section integral with and offset from said first section and at a first predetermined angle, extending parallel to said longitudinal axis, and adapted to be positioned in covering relation to said second surface when said first section is in engaging relation to said second surface; and (iii) a third section integral with and extending at a second predetermined angle from said second section, opposite said first section, said third section being adapted to engage said second surface when said second section is positioned in covering relation thereto.

2. The guard according to claim 1, wherein said first section is of a U-shaped cross-sectional shape.

3. The guard according to claim 1, wherein said first predetermined angle is about 55 degrees.

4. The guard according to claim 1 wherein said second predetermined angles is about 80 degrees.

* * * * *